US011508325B2

(12) United States Patent
Yuan et al.

(10) Patent No.: US 11,508,325 B2
(45) Date of Patent: Nov. 22, 2022

(54) PIXEL STRUCTURE, METHOD OF DRIVING THE SAME AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Jingchao Yuan, Beijing (CN); Zhaohui Meng, Beijing (CN); Wenchao Han, Beijing (CN); Wei Sun, Beijing (CN); Xue Dong, Beijing (CN); Ming Chen, Beijing (CN)

(73) Assignees: CHONGQING BOE OPTOELECTRONICS TECHNOLOGY CO., LTD., Chongqing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/957,659

(22) PCT Filed: Dec. 26, 2019

(86) PCT No.: PCT/CN2019/128529
§ 371 (c)(1),
(2) Date: Jun. 24, 2020

(87) PCT Pub. No.: WO2020/181880
PCT Pub. Date: Sep. 17, 2020

(65) Prior Publication Data

US 2021/0225304 A1 Jul. 22, 2021

(30) Foreign Application Priority Data

Mar. 8, 2019 (CN) ..... 201910175791.4

(51) Int. Cl.
*G09G 3/36* (2006.01)

(52) U.S. Cl.
CPC ..... *G09G 3/3607* (2013.01); *G09G 3/3648* (2013.01); *G09G 3/3674* (2013.01); *G09G 3/3685* (2013.01); *G09G 2300/0443* (2013.01)

(58) Field of Classification Search
CPC .. G09G 3/3607; G09G 3/3648; G09G 3/3674; G09G 3/3685; G09G 2300/0443
See application file for complete search history.

(56) References Cited

U.S. PATENT DOCUMENTS 6,140,990 A * 10/2000 Schlig ..... G09G 3/3659 345/94
6,707,441 B1 * 3/2004 Hebiguchi ..... G09G 3/3648 349/59

(Continued)

FOREIGN PATENT DOCUMENTS

CN 102201215 A 9/2011
CN 102855837 A 1/2013

(Continued)

OTHER PUBLICATIONS

1st Chinese Office Action, English Translation.

(Continued)

*Primary Examiner* — Benyam Ketema
(74) *Attorney, Agent, or Firm* — Brooks Kushman P.C.

(57) ABSTRACT

The present disclosure provides a pixel structure, a method of driving the same and a display device. The pixel structure includes gate lines, data lines, and a plurality of subpixels arranged in an array form. Subpixels in each row correspond to two gate lines. Each data line corresponds to the subpixels in two adjacent columns, and each data line is arranged between the two adjacent columns of subpixels. Among the subpixels in each row, three adjacent subpixels are in different colors and forms a complete pixel unit. Among the (Continued)

subpixels in each column, three adjacent subpixels are in different colors and forms the complete pixel unit. Among the subpixels in two adjacent columns, the subpixels in two adjacent rows form two complete pixel units each including three subpixels, and two of the three subpixels are shared by the two pixel unit.

14 Claims, 8 Drawing Sheets

(56) References Cited

U.S. PATENT DOCUMENTS

| | | | | |
|---|---|---|---|---|
| 7,868,861 | B2 * | 1/2011 | Cho | G09G 3/3648 345/694 |
| 8,773,419 | B2 * | 7/2014 | Nam | G09G 3/3648 345/212 |
| 9,024,850 | B2 * | 5/2015 | Lee | G09G 3/3648 345/694 |
| 9,341,905 | B1 * | 5/2016 | Li | H01L 27/124 |
| 9,523,901 | B2 * | 12/2016 | Li | G02F 1/1368 |
| 10,204,536 | B2 * | 2/2019 | Xue | H01L 27/3276 |
| 10,914,998 | B2 * | 2/2021 | Xu | H01L 21/28506 |
| 11,107,409 | B2 * | 8/2021 | Yang | G09G 3/3266 |
| 2001/0015715 | A1 * | 8/2001 | Hebiguchi | G09G 3/3648 345/92 |
| 2007/0057877 | A1 * | 3/2007 | Choi | G09G 3/3291 345/76 |
| 2008/0100760 | A1 | 5/2008 | Lee et al. | |
| 2008/0106535 | A1 * | 5/2008 | Kim | G09G 3/3648 345/87 |
| 2008/0266225 | A1 * | 10/2008 | Kim | G09G 3/3648 345/88 |
| 2009/0140253 | A1 * | 6/2009 | Kasahara | H01L 27/1214 257/59 |
| 2010/0156954 | A1 * | 6/2010 | Kim | G09G 3/3688 345/690 |
| 2011/0285950 | A1 * | 11/2011 | Su | G09G 3/3648 349/139 |
| 2012/0092241 | A1 * | 4/2012 | Shang | G09G 3/3648 345/87 |
| 2014/0071033 | A1 | 3/2014 | Meng | |
| 2014/0266995 | A1 * | 9/2014 | Cho | G09G 3/3607 345/88 |
| 2015/0084939 | A1 | 3/2015 | Chen et al. | |
| 2015/0185532 | A1 * | 7/2015 | Zheng | G09G 3/3648 349/144 |
| 2016/0117969 | A1 | 4/2016 | Qin et al. | |
| 2016/0233234 | A1 * | 8/2016 | Yang | G09G 3/2003 |
| 2016/0307525 | A1 * | 10/2016 | Wang | G09G 3/3607 |
| 2016/0342058 | A1 | 11/2016 | Park et al. | |
| 2017/0053608 | A1 * | 2/2017 | Li | G09G 3/3607 |
| 2017/0178578 | A1 * | 6/2017 | Du | G09G 3/3614 |
| 2018/0018938 | A1 * | 1/2018 | Lee | G09G 5/06 |
| 2018/0261169 | A1 * | 9/2018 | Du | G09G 3/3607 |
| 2018/0314088 | A1 | 11/2018 | Gan et al. | |
| 2018/0315384 | A1 * | 11/2018 | Ikeda | G09G 3/007 |
| 2019/0206950 | A1 | 7/2019 | Chen | |
| 2021/0166642 | A1 * | 6/2021 | He | G09G 3/3648 |

FOREIGN PATENT DOCUMENTS

| | | | |
|---|---|---|---|
| CN | 102881268 | A | 1/2013 |
| CN | 103187038 | A | 7/2013 |
| CN | 103514846 | A | 1/2014 |
| CN | 103926765 | A | 7/2014 |
| CN | 104375302 | A | 2/2015 |
| CN | 104749847 | A | 7/2015 |
| CN | 105446034 | A | 3/2016 |
| CN | 106932985 | A | 7/2017 |
| CN | 107092144 | A | 8/2017 |
| CN | 108051943 | A | 5/2018 |
| CN | 108519698 | A | 9/2018 |
| CN | 108732832 | A | 11/2018 |
| CN | 109426038 | A | 3/2019 |
| CN | 109697967 | A | 4/2019 |

OTHER PUBLICATIONS

2nd Chinese Office Action, English Translation.
3rd Chinese Office Action, English Translation.
International Search Report and Written Opinion, English Translation.
First Office Action for Chinese Application No. 201910175791 4, dated Jan. 16, 2020, 8 Pages.
Second Office Action for Chinese Application No. 201910175791.4, dated Jun. 24, 2020, 8 Pages.
Third Office Action for Chinese Application No. 201910175791.4, dated Sep. 28, 2020, 8 Pages.
International Search Report and Written Opinion for Application No. PCT/CN2019/128529, dated Mar. 26, 2020, 11 Pages.

* cited by examiner

PIXEL STRUCTURE, METHOD OF DRIVING THE SAME AND DISPLAY DEVICE

CROSS-REFERENCE TO RELATED APPLICATIONS

This application is the U.S. national phase of PCT Application No. PCT/CN2019/128529 filed on Dec. 26, 2019, which claims priority to Chinese Patent Application No. 201910175791.4 filed on Mar. 8, 2019, which are incorporated herein by reference in their entireties.

TECHNICAL FIELD

The present disclosure relates to the field of display technology, in particular to a pixel structure, a method of driving the same and a display device.

BACKGROUND

Currently, a display device usually includes a plurality of pixel units arranged in an array form, and each pixel unit includes a red subpixel, a green subpixel and a blue subpixel. In actual use, a light beam in a corresponding color is emitted by each subpixel of the pixel unit, and light beams emitted by the subpixels are combined into a light beam emitted by the pixel unit, so as to achieve a display function of the display device. However, in actual use, there is very close distance between adjacent pixel units, so the light beams emitted by the subpixels of the adjacent pixel units may interfere with each other. At this time, a color uniformity of the display device may be adversely affected, and thereby a user experience may be adversely affected too.

SUMMARY

In one aspect, the present disclosure provides in some embodiments a pixel structure, including a plurality of gate lines, a plurality of data lines each crossing the plurality of gate lines, and a plurality of subpixels arranged in an array form. Subpixels in each row correspond to two gate lines, one of the two gate lines is connected to parts of the subpixels in the row, and the other of the two gate lines is connected to the other subpixels in the row. Each data line corresponds to the subpixels in two adjacent columns, the subpixels in one column of the two adjacent columns are arranged at a first side of the data line, the subpixels in the other column of the two adjacent columns are arranged at a second side of the data line opposite to the first side, and the data line is connected to the subpixels in the two adjacent columns. Among the subpixels in each row, three adjacent subpixels are in different colors and form a complete pixel unit. Among the subpixels in each column, three adjacent subpixels are in different colors and form the complete pixel unit. Among the subpixels in two adjacent columns, the subpixels in two adjacent rows form two complete pixel units each including three subpixels, and two of the three subpixels are shared by the two complete pixel units.

In a possible embodiment of the present disclosure, among the subpixels in the two adjacent columns, a subpixel of the subpixels in one row of the two adjacent rows at the first side is in a same color as a subpixel of the subpixels in the other row of the two adjacent rows at the second side, and a subpixel of the subpixels in the one row of the two adjacent rows at the second side is in a color different from a subpixel of the subpixels in the other row of the two adjacent rows at the first side.

In a possible embodiment of the present disclosure, the subpixels in each row are arranged between two corresponding gate lines, one of the two gate lines corresponding to the subpixels in each row is connected to odd-numbered subpixels of the subpixels in the row, and the other of the two gate lines is connected to even-numbered subpixels of the subpixels in the row.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a red subpixel, a green subpixel and a blue subpixel arranged sequentially in a direction perpendicular to the extension direction of the data line from the second side to the first side of the data line, the second pixel unit includes a green subpixel, a blue subpixel and a red subpixel arranged sequentially in the direction perpendicular to the extension direction of the data line from the second side to the first side of the data line, and the third pixel unit includes a blue subpixel, a red subpixel and a green subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a red subpixel, a blue subpixel and a green subpixel arranged sequentially in a direction perpendicular to the extension direction of the data line from the second side to the first side of the data line, the second pixel unit includes a blue subpixel, a green subpixel and a red subpixel arranged sequentially in the direction perpendicular to the extension direction of the data line from the second side to the first side of the data line, and the third pixel unit includes a green subpixel, a red subpixel and a blue subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a green subpixel, a blue subpixel and a red subpixel arranged sequentially in a direction perpendicular to the extension direction of the data line from the second side to the first side of the data line, the second pixel unit includes a blue subpixel, a red subpixel and a green subpixel arranged sequentially in the direction perpendicular to the extension direction of the data line from the second side to the first side of the data line, and the third pixel unit includes a red subpixel, a green subpixel and a blue subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a green subpixel, a red subpixel and a blue subpixel arranged sequentially in a direction perpendicular to the extension direction of the data line from the second side to the first side of the data line, the second pixel unit includes a red subpixel, a blue subpixel and a green subpixel arranged sequentially in the direction perpendicular to the extension direction of the data line from the second side to the first side of the data line, and the third pixel unit includes a blue subpixel, a green subpixel and a red subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a blue subpixel, a red subpixel and a green subpixel arranged sequentially in a direction perpendicular to the extension direction of the data line from the second side to the first side of the data line, the second pixel unit includes a red subpixel, a green subpixel and a blue subpixel arranged sequentially in the direction perpendicular to the extension direction of the data line from the second side to the first side of the data line, and the third pixel unit includes a green subpixel, a blue subpixel and a red subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a blue subpixel, a green subpixel and a red subpixel arranged sequentially in a direction perpendicular to the extension direction of the data line from the second side to the first side of the data line, the second pixel unit includes a green subpixel, a red subpixel and a blue subpixel arranged sequentially in the direction perpendicular to the extension direction of the data line from the second side to the first side of the data line, and the third pixel unit includes a red subpixel, a blue subpixel and a green subpixel arranged sequentially in the direction perpendicular to the extension direction of the data line from the second side to the first side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a red subpixel, a green subpixel and a blue subpixel arranged sequentially in a direction perpendicular to the extension direction of the data line from the first side to the second side of the data line, the second pixel unit includes a green subpixel, a blue subpixel and a red subpixel arranged sequentially in the direction perpendicular to the extension direction of the data line from the first side to the second side of the data line, and the third pixel unit includes a blue subpixel, a red subpixel and a green subpixel arranged sequentially in the direction perpendicular to the extension direction of the data line from the first side to the second side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a red subpixel, a blue subpixel and a green subpixel arranged sequentially in a direction perpendicular to the extension direction of the data line from the first side to the second side of the data line, the second pixel unit includes a blue subpixel, a green subpixel and a red subpixel arranged sequentially in the direction perpendicular to the extension direction of the data line from the first side to the second side of the data line, and the third pixel unit includes a green subpixel, a red subpixel and a blue subpixel arranged sequentially in the direction perpendicular to the extension direction of the data line from the first side to the second side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a green subpixel, a blue subpixel and a red subpixel arranged sequentially in a direction perpendicular to the extension direction of the data line from the first side to the second side of the data line, the second pixel unit includes a blue subpixel, a red subpixel and a green subpixel arranged sequentially in the direction perpendicular to the extension direction of the data line from the first side to the second side of the data line, and the third pixel unit includes a red subpixel, a green subpixel and a blue subpixel arranged sequentially in the direction perpendicular to the extension direction of the data line from the first side to the second side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a green subpixel, a red subpixel and a blue subpixel arranged sequentially in a direction perpendicular to the extension direction of the data line from the first side to the second side of the data line, the second pixel unit includes a red subpixel, a blue subpixel and a green subpixel arranged sequentially in the direction perpendicular to the extension direction of the data line from the first side to the second side of the data line, and the third pixel unit includes a blue subpixel, a green subpixel and a red subpixel arranged sequentially in the direction perpendicular to the extension direction of the data line from the first side to the second side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a blue subpixel, a red subpixel and a green subpixel arranged sequentially in a direction perpendicular to the extension direction of the data line from the first side to the second side of the data line, the second pixel unit includes a red subpixel, a green subpixel and a blue subpixel arranged sequentially in the direction perpendicular to the extension direction of the data line from the first side to the second side of the data line, and the third pixel unit includes a green subpixel, a blue subpixel and a red subpixel arranged sequentially in the direction perpendicular to the extension direction of the data line from the first side to the second side of the data line.

In a possible embodiment of the present disclosure, the plurality of subpixels includes a plurality of red subpixels, a plurality of green subpixels and a plurality of blue subpixels, the plurality of subpixels forms a plurality of repetition modules arranged in an array form, and each repetition module includes a first pixel unit, a second pixel unit and a third pixel unit arranged sequentially in an extension direction of the data line. The first pixel unit includes a blue subpixel, a green subpixel and a red subpixel arranged sequentially in a direction perpendicular to the extension direction of the data line from the first side to the second side of the data line, the second pixel unit includes a green subpixel, a red subpixel and a blue subpixel arranged sequentially in the direction perpendicular to the extension direction of the data line from the first side to the second side of the data line, and the third pixel unit includes a red subpixel, a blue subpixel and a green subpixel arranged sequentially in the direction perpendicular to the extension direction of the data line from the first side to the second side of the data line.

In another aspect, the present disclosure provides in some embodiments a display device including the above-mentioned pixel structure.

In yet another aspect, the present disclosure provides in some embodiments a method for driving the above-mentioned pixel structure, including, with one frame, applying a gate driving signal to the gate lines one by one, and applying a corresponding data signal to each data line when the gate driving signal is applied to each gate line.

In a possible embodiment of the present disclosure, when applying the corresponding data signal to each data line, a data signal applied to the subpixels in each odd-numbered row has a voltage polarity opposite to a data signal applied to the subpixels in each even-numbered row, and/or a data signal applied to the subpixels in each odd-numbered column has a voltage polarity opposite to a data signal applied to the subpixels in each even-numbered column.

BRIEF DESCRIPTION OF THE DRAWINGS

The following drawings are provided to facilitate the understanding of the present disclosure, and constitute a portion of the present disclosure. These drawings and the following embodiments are for illustrative purposes only, but shall not be construed as limiting the present disclosure. In these drawings.

DETAILED DESCRIPTION

In order to further illustrate a pixel structure, a method for driving the pixel structure and a display device in the embodiments of the present disclosure, a detailed description will be given below with reference to the drawings of the specification.

Figure 1:
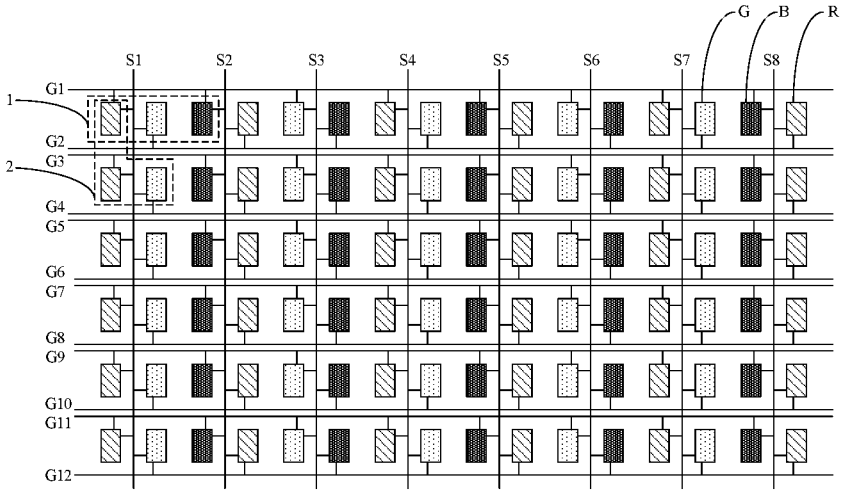
Fig. 1 (Prior Art)
FIG. 1 is a schematic view showing a pixel structure in the related art.

As shown in FIG. 1, in the related art, a pixel structure of a display device usually includes red subpixels R, green subpixels G and blue subpixel B arranged alternately in columns, and for subpixels in each row, three adjacent subpixels (RGB) form a complete pixel unit 1. However, as shown in FIG. 1, when the display device with this kind of pixel structure is driven to display an image, for the subpixels in two adjacent rows, such interference light beams as RRG (e.g., sign 2 in FIG. 1) and RGG may occur. At this time, a light beam actually emitted by the pixel unit 1 is easily different from a light beam actually desired, so a color uniformity of the display device as well as a user experience may be adversely affected.

Based on the above problem, it is found through study that, during an arrangement of the pixel structure of the display device, in addition to that the three adjacent subpixels of the subpixels in each row are set to form the complete pixel unit 1, three adjacent subpixels of the subpixels in each column may also be set to form the complete pixel unit 1, and three adjacent subpixels in a direction parallel to a diagonal line may also be set to form the complete pixel unit 1. In this regard, it is able to prevent the subpixels in the adjacent complete pixel units 1 from interfering with each other, thereby to ensure the color uniformity of the display device. The so-called "complete pixel unit" may refer to a pixel unit including the subpixels in all colors. For example, when colors of the subpixels include red, blue and green, the complete pixel unit may include the red subpixel R, the green subpixel G and the blue subpixel B.

Figure 2:
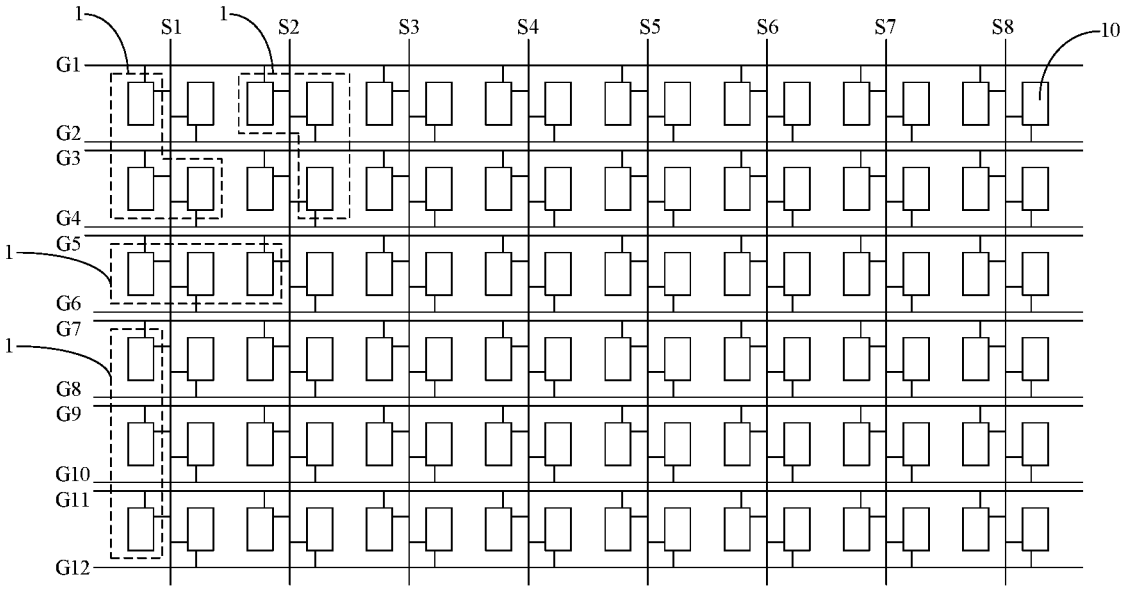
FIG. 2 is a schematic view showing a pixel structure according to one embodiment of the present disclosure.

As shown in FIG. 2, a pixel structure is provided in some embodiments of the present disclosure, including a plurality of gate lines G (e.g., G1 to G12 in FIG. 2), a plurality of data lines S (e.g., S1 to S8 in FIG. 2) each crossing the plurality of gate lines G, and a plurality of subpixels 10 arranged in an array form. Subpixels 10 in each row correspond to two gate lines G, one of the two gate lines G is connected to parts of the subpixels 10 in the row, and the other of the two gate lines G is connected to the other subpixels 10 in the row. Each data line S corresponds to the subpixels 10 in two adjacent columns, the subpixels 10 in one column of the two adjacent columns are arranged at a first side of the data line S, the subpixels 10 in the other column of the two adjacent columns are arranged at a second side of the data line S opposite to the first side, and the data line S is connected to the subpixels 10 in the two adjacent columns. Among the subpixels 10 in each row, three adjacent subpixels 10 are in different colors and form a complete pixel unit 1. Among the subpixels 10 in each column, three adjacent subpixels 10 are in different colors and form the complete pixel unit 1. Among the subpixels 10 in two adjacent columns, the subpixels 10 in two adjacent rows form two complete pixel units 1 each including three subpixels 10, and two of the three subpixels 10 are shared by the two complete pixel units 1.

In the above pixel structure, the subpixels 10 in each row may correspond to two gate lines G, and positions of the two gate lines G may be set according to practical needs. Illustratively, the two gate lines G may be arranged at a same side of the corresponding subpixels 10, or at opposite sides thereof respectively. In addition, one of the two gate lines G may be connected to parts of the corresponding subpixels 10, and the other of the two gate lines G may be connected to the remaining ones of the corresponding subpixels 10. In the pixel structure, each data line S may correspond to the subpixels 10 in two adjacent columns and be arranged between the two columns of subpixels 10. In addition, the subpixels 10 in each column in the pixel structure may merely correspond to one data line S, and the data line S may be connected to the corresponding subpixels 10 in the two adjacent columns.

Among the plurality of subpixels 10 arranged in an array form, three adjacent subpixels 10 may be in different colors and capable of forming the complete pixel unit 1. Among the subpixels 10 in each column, three adjacent subpixels 10 may be in different colors and capable of forming the complete pixel unit 1. Among the subpixels 10 in two adjacent columns, the subpixels 10 in two adjacent rows may be capable of forming two complete pixel units 1 each including three subpixels 10, and two of the three subpixels 10 may be shared by the two complete pixel units 1. In this kind of pixel structure, taking nine subpixels 10 arranged at any position in a 3*3 (three rows*three columns) mode as an example, the three subpixels 10 in each row may form the complete pixel unit 1, and the three subpixels 10 in each column may also form the complete pixel unit 1. In addition, among the nine subpixels 10, the subpixels 10 arranged at any position in a 2*2 mode may form two complete pixel units 1. Hence, for the nine subpixels 10 arranged in the above mode, the three adjacent subpixels 10 in each of a row direction and a column direction may form the complete pixel unit 1, and for the subpixels 10 arranged in the 2*2 mode in the nine subpixels 10, the three adjacent subpixels 10 in each of directions corresponding to "└" and "┐", or directions corresponding to "┌" and "┘", may also form a complete pixel unit 1.

Based on the above, according to the pixel structure in the embodiments of the present disclosure, three adjacent subpixels 10 in each row may form the complete pixel unit 1, and three adjacent pixels 10 in each column may also form the complete pixel unit 1. In addition, among the subpixels 10 in any two adjacent columns, the subpixels 10 in two adjacent rows may form two complete pixel units 1 in the directions corresponding to "└" and "┐", or directions corresponding to "┌" and "┘". When the pixel structure is applied to a display device and the display device is driven to display an image, it is able to form the complete pixel unit 1 through the subpixels 10 in two adjacent rows and in two adjacent columns, so as to prevent a normal display effect from being adversely affected by a combined light beam generated by the adjacent pixel units 1, thereby to ensure the color uniformity of the display device. In addition, it is able to form the complete pixel units 1 in various direction, so as to enrich display colors of the display device and improve the user experience.

In addition, according to the pixel structure in the embodiments of the present disclosure, the subpixels 10 in each row may correspond to two gate lines G, one of the two gate lines G may be connected to parts of the corresponding subpixels 10 in the row, and the other of the two gate lines G may be connected to the other ones of the corresponding subpixels 10 in the row. Each data line S may correspond to the subpixels 10 in two adjacent columns and be arranged between the two columns of subpixels 10, and each data line S may be connected to the subpixels 10 in the two adjacent columns. Through setting a connection mode for the gate lines G, it is able to drive the subpixels 10 connected to a same data line S and arranged in a same row through different gate lines G, thereby to ensure a normal display of the pixel structure. In addition, each data line S is configured to apply a data signal to the subpixels 10 in two adjacent columns, so it is able to reduce the quantity of the data lines S without changing a transmission distance of each data line S, thereby to save a layout space of the pixel structure.

It should be appreciated that, when the pixel structure in the embodiments of the present disclosure is applied to a liquid crystal display device, colors of color filter units on a color film substrate of the liquid crystal display device may correspond to the colors of the subpixels 10 of the pixel structure respectively, and in a direction perpendicular to the color film substrate, each color filter unit may at least partially overlap a corresponding subpixel 10.

The pixel structure in the embodiments may be in various forms. Illustratively, among the subpixels 10 in two adjacent columns, the subpixel 10 of the subpixels 10 in one row of two adjacent rows at the first side may be in a same color as the subpixel 10 of the subpixels 10 in the other row of the two adjacent rows at the second side, and the subpixel 10 of the subpixels 10 in one row of two adjacent rows at the second side may be in a color different from the subpixel 10 of the subpixels 10 in the other row of the two adjacent rows at the first side.

To be specific, in the above pixel structure, three adjacent subpixels 10 in each row may be in different colors and capable of forming the complete pixel unit 1, and three adjacent subpixels 10 in each column may be in different colors and capable of forming the complete pixel unit 1. Based on this, among the subpixels 10 in two adjacent columns, the subpixel 10 of the subpixels 10 in one row of two adjacent rows at the first side may be in the same color as the subpixel 10 of the subpixels 10 in the other row of the two adjacent rows at the second side, and the subpixel 10 of the subpixels 10 in one row of the two adjacent rows at the second side may be in the color different from the subpixel 10 of the subpixels 10 in the other row of the two adjacent rows at the first side. In this regard, it is able for the subpixels 10 in two adjacent rows and in any two adjacent columns to form two pixel units 1 in the directions corresponding to "└" and "┐", or directions corresponding to "┌" and "┘".

In subpixel distribution modes as shown in FIGS. 3 to 8, for four subpixels 10 arranged at any position in the 2*2 (two rows*two columns) mode, i.e., an upper left subpixel 10, an upper right subpixel 10, a lower left subpixel 10 and a lower right subpixel 10, the upper right subpixel 10 may be in a same color as the lower left subpixel 10, and the upper left subpixel 10 may be in a color different from the lower right subpixel 10. Hence, with respect to the distribution modes in FIGS. 3 to 8, it is able for the subpixels 10 in two adjacent rows and in any two adjacent columns to form two complete pixel units 1 in the directions corresponding to "└" and "┐".

Of course, FIGS. 3 to 8 merely relate to some examples of the pixel structure. In some embodiments of the present disclosure, as shown in FIGS. 9 to 14, for the four subpixels arranged at any position in the 2*2 (two rows*two columns) mode, the upper left subpixel 10 may be in a same color as the lower right subpixel 10, and the upper right subpixel 10 may be in a color different from the lower left subpixel 10, so it is able for the subpixels 10 in two adjacent rows and in any two adjacent columns to form two complete pixel units 1 in the directions corresponding to "┌" and "┘".

Hence, when the pixel structure in the embodiments of the present disclosure is applied to the display device and the display device is driven to display an image, it is able for the subpixels 10 in two adjacent rows and in two adjacent columns to form the complete pixel units 1, so as to prevent the normal display effect from being adversely affected by a combined light beam generated by the adjacent pixel units 1, thereby to ensure the color uniformity of the display device and improve the user experience.

As shown in FIG. 2, for the pixel structure in the embodiments of the present disclosure, the subpixels 10 in each row may be arranged between two corresponding gate lines G, one gate line G of the two gate lines G corresponding to the subpixels 10 in each row may be connected to odd-numbered subpixels 10 of the subpixels 10 in the row, and the other gate line G may be connected to even-numbered subpixels 10 of the subpixels 10 in the row.

To be specific, when the gate lines G are arranged as mentioned above, the gate lines G corresponding to the subpixels 10 in each row may be arranged at a same layer. When the subpixels 10 are connected to the corresponding gate lines G, it is able to prevent an occurrence of a short circuit when the gate line G crosses the other gate lines G. In addition, when a driving signal is applied through one gate line G, the subpixels 10 arranged in a same row and connected to a same data line S may not be driven simultaneously, so it is able to apply the data signal to merely one subpixel 10 through each data line S in a same time period, thereby to enable the pixel structure to achieve a normal di splay function.

Further, the subpixels 10 of the pixel structure in the embodiments of the present disclosure may be of various types. Illustratively, the plurality of subpixels 10 of the pixel structure may include a plurality of red subpixels R, a plurality of green subpixels G and a plurality of blue subpixels B, the plurality of subpixels 10 may form a plurality of repetition modules arranged in an array form, and each repetition module may include a first pixel unit, a second pixel unit and a third pixel unit arranged sequentially in an extension direction of the data line S. Several distribution modes of the subpixels 10 in the first pixel unit, the second pixel unit and the third pixel unit will be described herein, but the present disclosure shall not be limited thereto.

Figure 3:
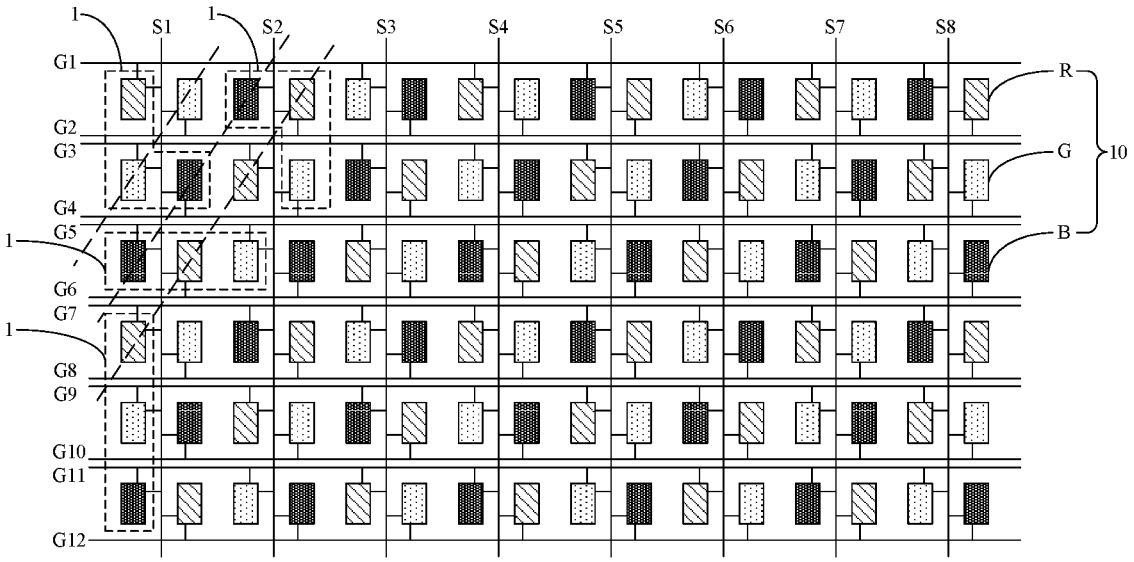
FIG. 3 is a schematic view showing the pixel structure in a first distribution mode according to one embodiment of the present disclosure.

In a first mode, as shown in FIG. 3, the first pixel unit may include a red subpixel R, a green subpixel G and a blue subpixel B arranged sequentially in a direction perpendicular to the extension direction of the data line S from the second side to the first side of the data line S, the second pixel unit may include a green subpixel G, a blue subpixel B and a red subpixel R arranged sequentially in the direction perpendicular to the extension direction of the data line S from the second side to the first side of the data line S, and the third pixel unit may include a blue subpixel B, a red subpixel R and a green subpixel G arranged sequentially in the direction perpendicular to the extension direction of the data line S from the second side to the first side of the data line S.

Figure 4:
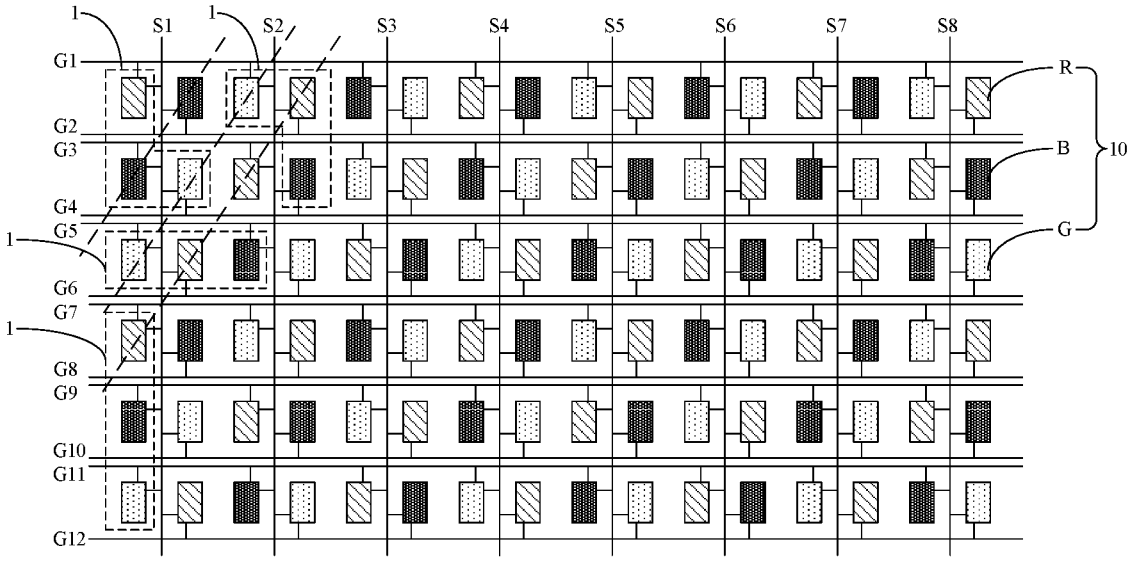
FIG. 4 is another schematic view showing the pixel structure in a second distribution mode according to one embodiment of the present disclosure.

In a second mode, as shown in FIG. 4, the first pixel unit may include a red subpixel R, a blue subpixel B and a green subpixel G arranged sequentially in a direction perpendicular to the extension direction of the data line S from the second side to the first side of the data line S, the second pixel unit may include a blue subpixel B, a green subpixel G and a red subpixel R arranged sequentially in the direction perpendicular to the extension direction of the data line S from the second side to the first side of the data line S, and the third pixel unit may include a green subpixel G, a red subpixel R and a blue subpixel B arranged sequentially in the direction perpendicular to the extension direction of the data line S from the second side to the first side of the data line S.

Figure 5:
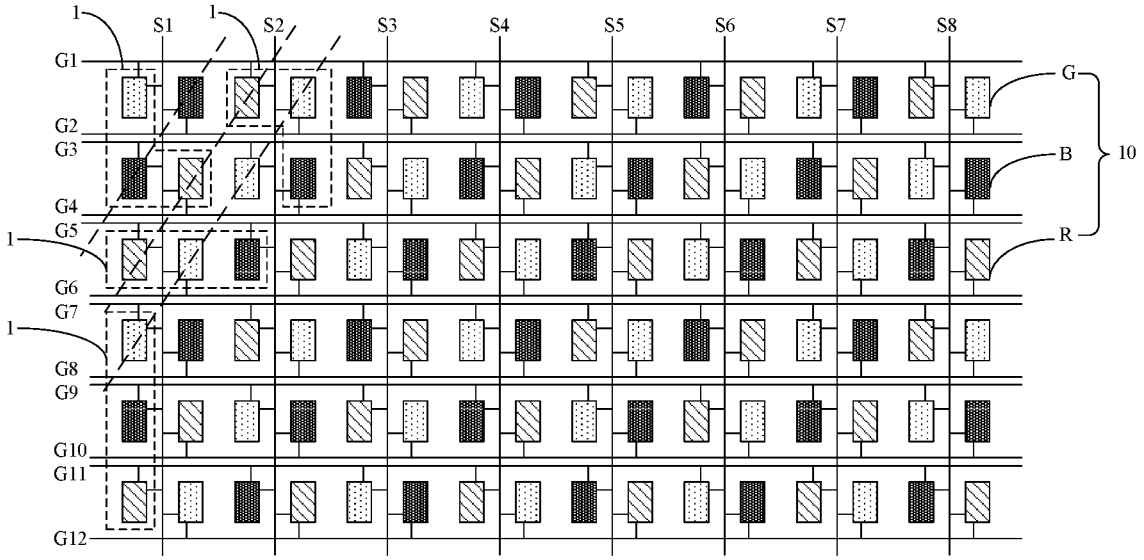
FIG. 5 is yet another schematic view showing the pixel structure in a third distribution mode according to one embodiment of the present disclosure.

In a third mode, as shown in FIG. 5, the first pixel unit may include a green subpixel G, a blue subpixel B and a red subpixel R arranged sequentially in a direction perpendicular to the extension direction of the data line S from the second side to the first side of the data line S, the second pixel unit may include a blue subpixel B, a red subpixel R and a green subpixel G arranged sequentially in the direction perpendicular to the extension direction of the data line S from the second side to the first side of the data line S, and the third pixel unit may include a red subpixel R, a green subpixel G and a blue subpixel B arranged sequentially in the direction perpendicular to the extension direction of the data line S from the second side to the first side of the data line S.

Figure 6:
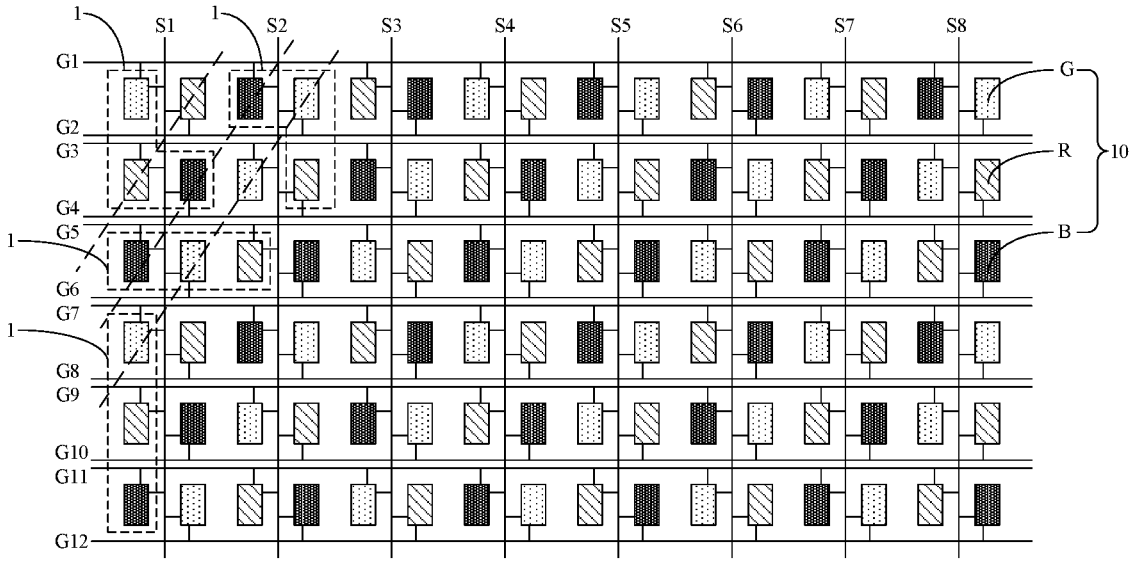
FIG. 6 is still yet another schematic view showing the pixel structure in a fourth distribution mode according to one embodiment of the present disclosure.

In a fourth mode, as shown in FIG. 6, the first pixel unit may include a green subpixel G, a red subpixel R and a blue subpixel B arranged sequentially in a direction perpendicular to the extension direction of the data line S from the second side to the first side of the data line S, the second pixel unit may include a red subpixel R, a blue subpixel B and a green subpixel G arranged sequentially in the direction perpendicular to the extension direction of the data line S from the second side to the first side of the data line S, and the third pixel unit may include a blue subpixel B, a green subpixel G and a red subpixel R arranged sequentially in the direction perpendicular to the extension direction of the data line S from the second side to the first side of the data line S.

Figure 7:
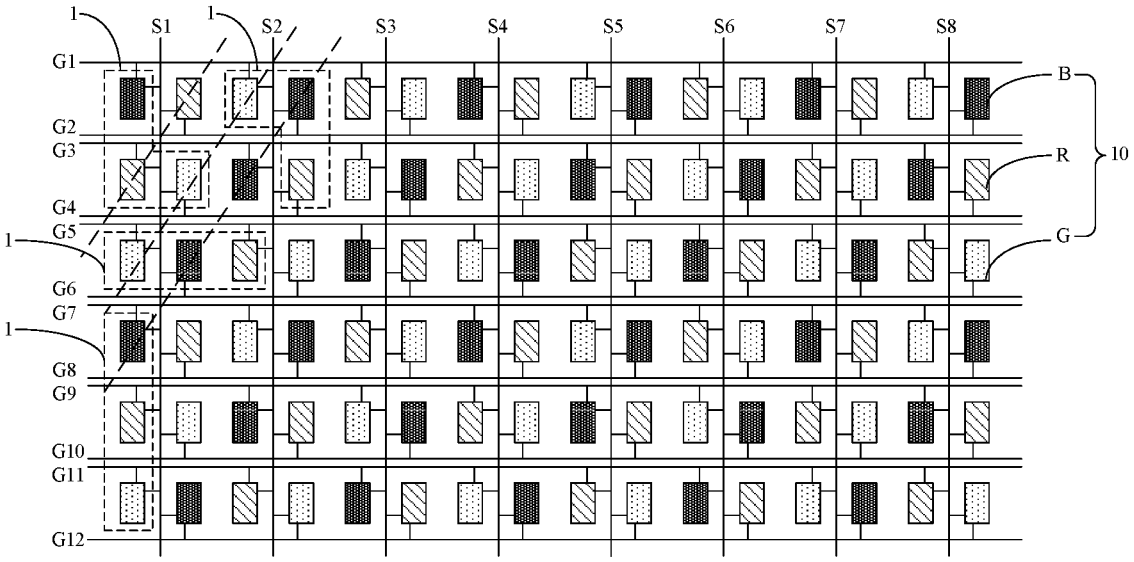
FIG. 7 is still yet another schematic view showing the pixel structure in a fifth distribution mode according to one embodiment of the present disclosure.

In a fifth mode, as shown in FIG. 7, the first pixel unit may include a blue subpixel B, a red subpixel R and a green subpixel G arranged sequentially in a direction perpendicular to the extension direction of the data line S from the second side to the first side of the data line S, the second pixel unit may include a red subpixel R, a green subpixel G and a blue subpixel B arranged sequentially in the direction perpendicular to the extension direction of the data line S from the second side to the first side of the data line S, and the third pixel unit may include a green subpixel G, a blue subpixel B and a red subpixel R arranged sequentially in the direction perpendicular to the extension direction of the data line S from the second side to the first side of the data line S.

Figure 8:
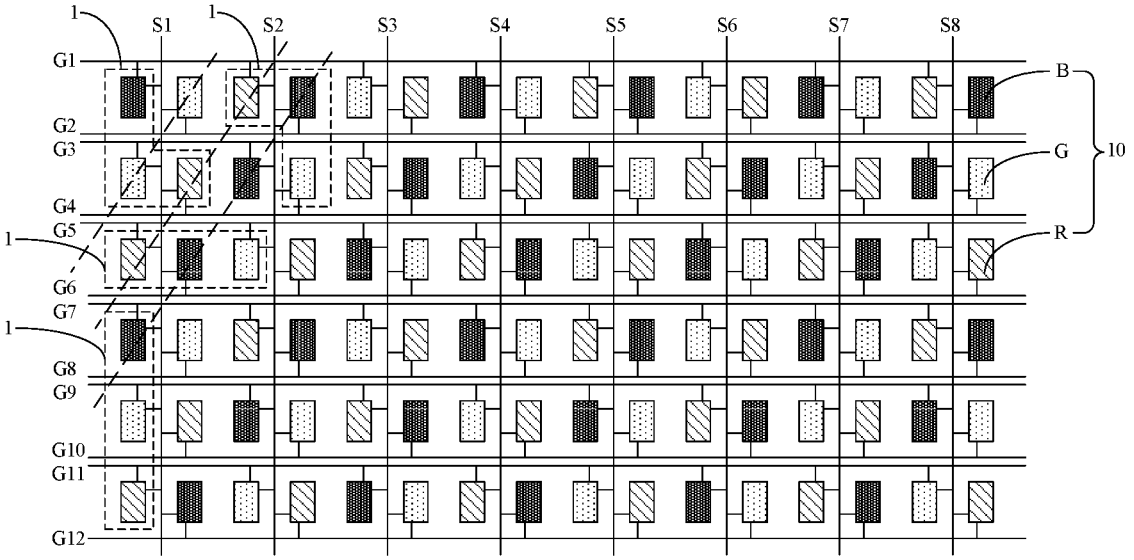
FIG. 8 is still yet another schematic view showing the pixel structure in a sixth distribution mode according to one embodiment of the present disclosure.

In a sixth mode, as shown in FIG. 8, the first pixel unit may include a blue subpixel B, a green subpixel G and a red subpixel R arranged sequentially in a direction perpendicular to the extension direction of the data line S from the second side to the first side of the data line S, the second pixel unit may include a green subpixel G, a red subpixel R and a blue subpixel B arranged sequentially in the direction perpendicular to the extension direction of the data line S from the second side to the first side of the data line S, and the third pixel unit may include a red subpixel R, a blue subpixel B and a green subpixel G arranged sequentially in the direction perpendicular to the extension direction of the data line S from the second side to the first side of the data line S.

In each of the six modes listed hereinabove, the three adjacent subpixels 10 in each row may be in different colors and form the complete pixel unit 1, the three adjacent subpixels 10 in each column may be in different colors and form the complete pixel unit 1, and the subpixels 10 in two adjacent rows and in any two adjacent columns may form two complete pixel units 1 in the directions corresponding to "└" and "┐".

In addition, for four subpixels 10 arranged at any position in the 2*2 (two rows*two columns) mode, the upper left subpixel 10 may be in the same color as the lower right subpixel 10, and the upper right subpixel 10 may be in the color different from the lower left subpixel 10. Several distribution modes will be listed hereinafter.

Figure 9:
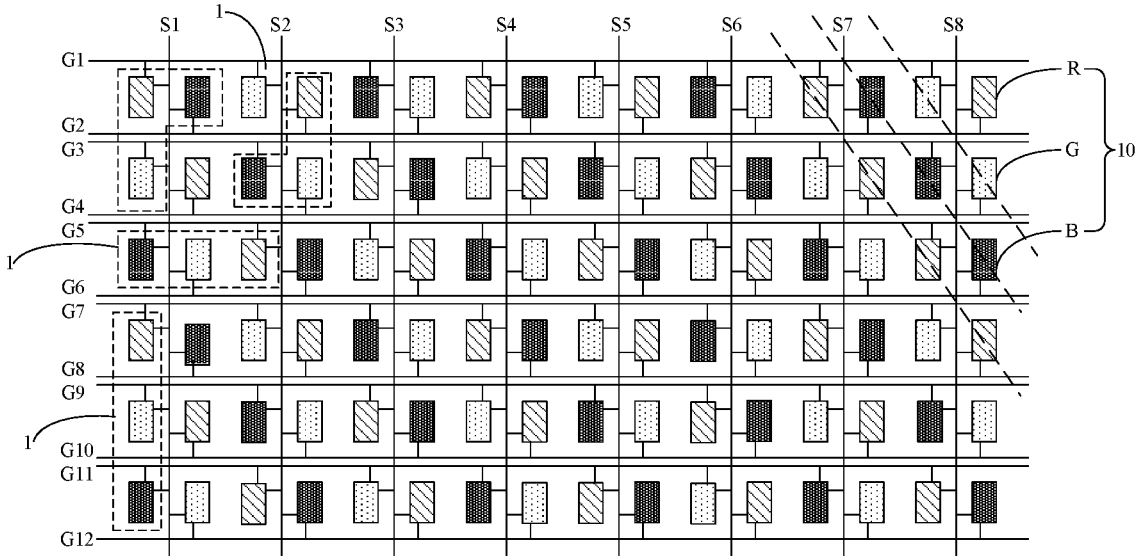
FIG. 9 is still yet another schematic view showing the pixel structure in a seventh distribution mode according to one embodiment of the present disclosure.

In a seventh mode, as shown in FIG. 9, the first pixel unit may include a red subpixel R, a green subpixel G and a blue subpixel B arranged sequentially in a direction perpendicular to the extension direction of the data line S from the first side to the second side of the data line S, the second pixel unit may include a green subpixel G, a blue subpixel B and a red subpixel R arranged sequentially in the direction perpendicular to the extension direction of the data line S from the first side to the second side of the data line S, and the third pixel unit may include a blue subpixel B, a red subpixel R and a green subpixel G arranged sequentially in the direction perpendicular to the extension direction of the data line S from the first side to the second side of the data line S.

Figure 10:
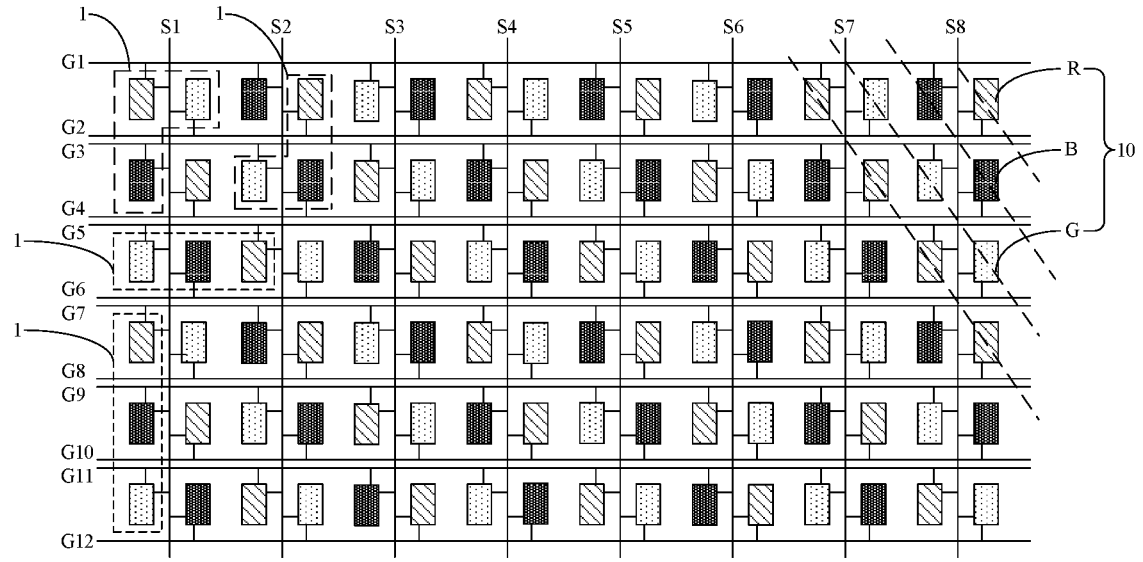
FIG. 10 is still yet another schematic view showing the pixel structure in an eighth distribution mode according to one embodiment of the present disclosure.

In an eighth mode, as shown in FIG. 10, the first pixel unit may include a red subpixel R, a blue subpixel B and a green subpixel G arranged sequentially in a direction perpendicular to the extension direction of the data line S from the first side to the second side of the data line S, the second pixel unit may include a blue subpixel B, a green subpixel G and a red subpixel R arranged sequentially in the direction perpendicular to the extension direction of the data line S from the first side to the second side of the data line S, and the third pixel unit may include a green subpixel G, a red subpixel R and a blue subpixel B arranged sequentially in the direction perpendicular to the extension direction of the data line S from the first side to the second side of the data line S.

Figure 11:
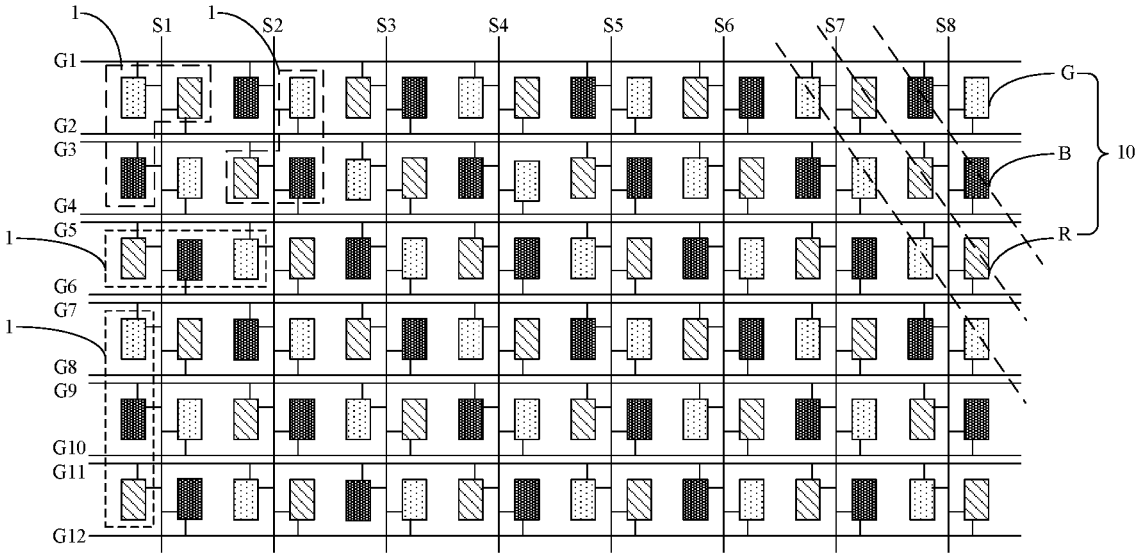
FIG. 11 is still yet another schematic view showing the pixel structure in a ninth distribution mode according to one embodiment of the present disclosure.

In a ninth mode, as shown in FIG. 11, the first pixel unit may include a green subpixel G, a blue subpixel B and a red subpixel R arranged sequentially in a direction perpendicular to the extension direction of the data line S from the first side to the second side of the data line S, the second pixel unit may include a blue subpixel B, a red subpixel R and a green subpixel G arranged sequentially in the direction perpendicular to the extension direction of the data line S from the first side to the second side of the data line S, and the third pixel unit may include a red subpixel R, a green subpixel G and a blue subpixel B arranged sequentially in the direction perpendicular to the extension direction of the data line S from the first side to the second side of the data line S.

Figure 12:
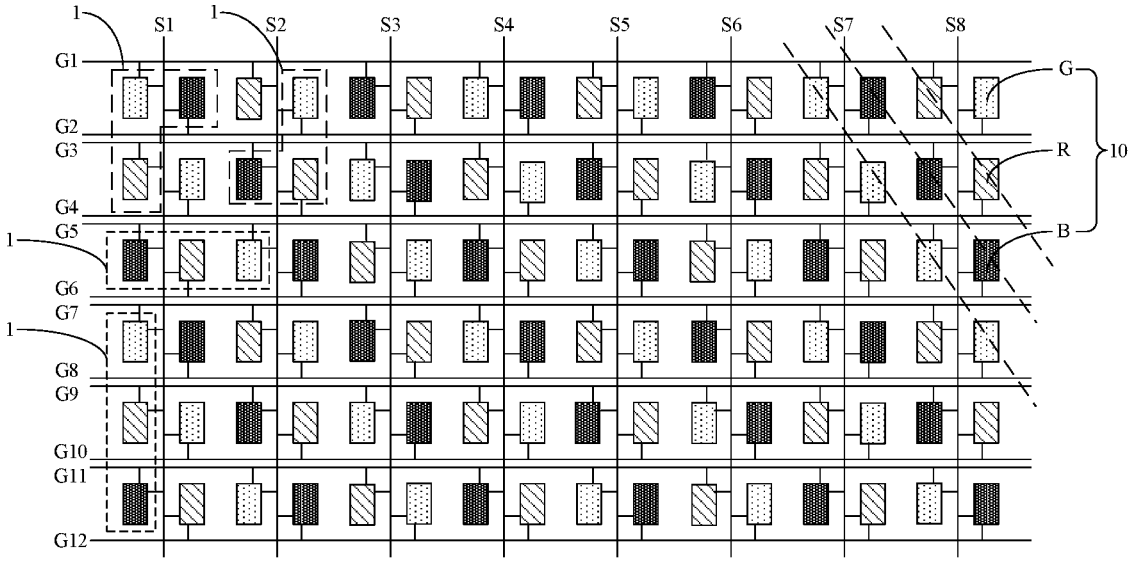
FIG. 12 is still yet another schematic view showing the pixel structure in a tenth distribution mode according to one embodiment of the present disclosure.

In a tenth mode, as shown in FIG. 12, the first pixel unit may include a green subpixel G, a red subpixel R and a blue subpixel B arranged sequentially in a direction perpendicular to the extension direction of the data line S from the first side to the second side of the data line S, the second pixel unit may include a red subpixel R, a blue subpixel B and a green subpixel G arranged sequentially in the direction perpendicular to the extension direction of the data line S from the first side to the second side of the data line S, and the third pixel unit may include a blue subpixel B, a green subpixel G and a red subpixel R arranged sequentially in the direction perpendicular to the extension direction of the data line S from the first side to the second side of the data line S.

Figure 13:
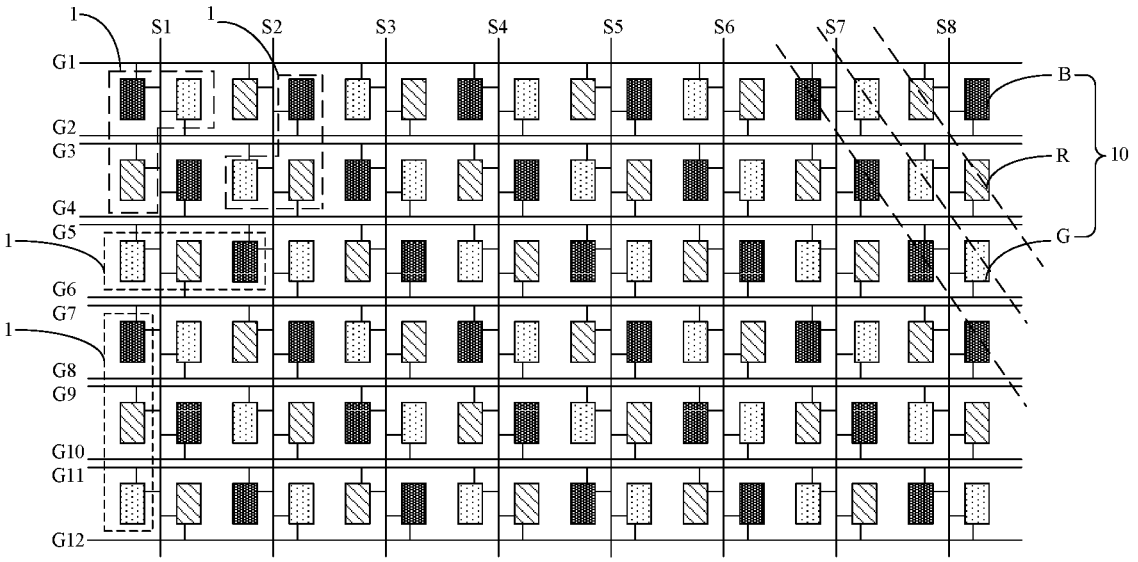
FIG. 13 is still yet another schematic view showing the pixel structure in an eleventh distribution mode according to one embodiment of the present disclosure.

In an eleventh mode, as shown in FIG. 13, the first pixel unit may include a blue subpixel B, a red subpixel R and a green subpixel G arranged sequentially in a direction perpendicular to the extension direction of the data line S from the first side to the second side of the data line S, the second pixel unit may include a red subpixel R, a green subpixel G and a blue subpixel B arranged sequentially in the direction perpendicular to the extension direction of the data line S from the first side to the second side of the data line S, and the third pixel unit may include a green subpixel G, a blue subpixel B and a red subpixel R arranged sequentially in the direction perpendicular to the extension direction of the data line S from the first side to the second side of the data line S.

Figure 14:
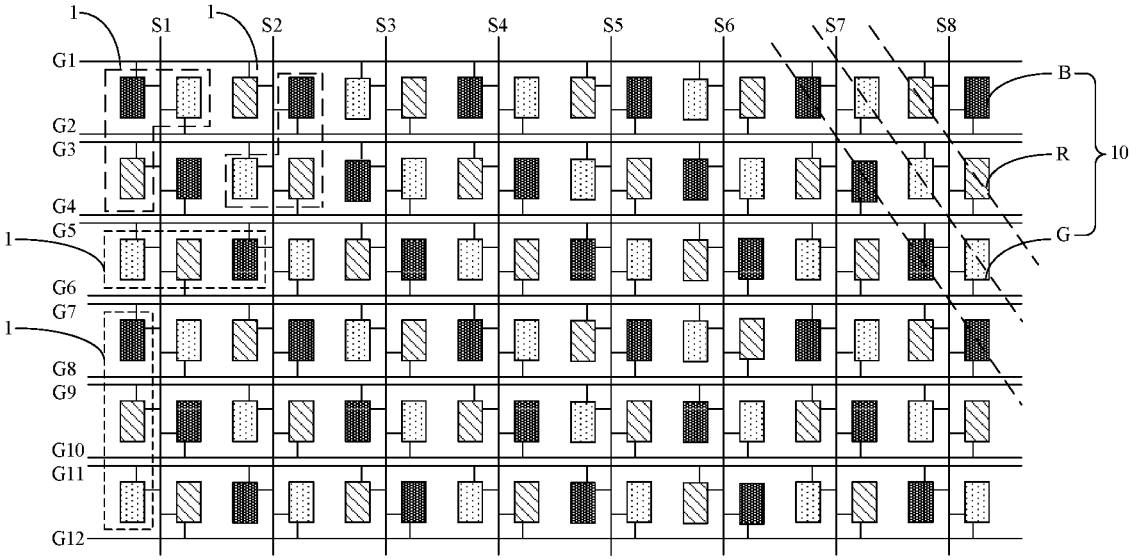
FIG. 14 is still yet another schematic view showing the pixel structure in a twelfth distribution mode according to one embodiment of the present disclosure.

In a twelfth mode, as shown in FIG. 14, the first pixel unit may include a blue subpixel B, a green subpixel G and a red subpixel R arranged sequentially in a direction perpendicular to the extension direction of the data line S from the first side to the second side of the data line S, the second pixel unit may include a green subpixel G, a red subpixel R and a blue subpixel B arranged sequentially in the direction perpendicular to the extension direction of the data line S from the first side to the second side of the data line S, and the third pixel unit may include a red subpixel R, a blue subpixel B and a green subpixel G arranged sequentially in the direction perpendicular to the extension direction of the data line S from the first side to the second side of the data line S.

In each of the six modes listed hereinabove, the three adjacent subpixels 10 in each row may be in different colors and form the complete pixel unit 1, the three adjacent subpixels 10 in each column may be in different colors and form the complete pixel unit 1, and the subpixels 10 in two adjacent rows and in any two adjacent columns may form two complete pixel units 1 in the directions corresponding to "⌐" and "⌟".

When the pixel structure in each of the above-mentioned twelve modes is applied to the display device and the display device is driven to display an image, it is able to form the complete pixel unit 1 through the subpixels 10 in two adjacent rows and in two adjacent columns, so as to prevent the normal display effect from being adversely affected by the combined light beam generated by the adjacent pixel units 1, thereby to ensure the color uniformity of the display device. In addition, it is able to enrich the display colors of the display device, thereby to improve the user experience.

In addition, in the above-mentioned twelve modes, the second side may be a left side of the data line S, and the first side may be a right side of the data line S.

A display device is further provided in some embodiments of the present disclosure including the above-mentioned pixel structure.

According to the pixel structure in the embodiments of the present disclosure, three adjacent subpixels 10 in each row may form the complete pixel unit 1, and three adjacent pixels 10 in each column may also form the complete pixel unit 1. In addition, among the subpixels 10 in any two adjacent columns, the subpixels 10 in two adjacent rows may form two complete pixel units 1 in the directions corresponding to "⌊" and "¬", or directions corresponding to "⌐" and "⌟". When the display device includes the pixel structure and it is driven to display an image, it is able to form the complete pixel unit 1 through the subpixels 10 in two adjacent rows and in two adjacent columns, so as to prevent a normal display effect from being adversely affected by a combined light beam generated by the adjacent pixel units 1, thereby to ensure the color uniformity of the display device. In addition, it is able to enrich display colors of the display device, thereby to improve the user experience.

In addition, according to the pixel structure in the embodiments of the present disclosure, the subpixels 10 in each row may correspond to two gate lines G, one of the two gate lines G may be connected to parts of the corresponding subpixels 10 in the row, and the other of the two gate lines G may be connected to the other ones of the corresponding subpixels 10 in the row. Each data line S may correspond to the subpixels 10 in two adjacent columns and be arranged between the two columns of subpixels 10, and each data line S may be connected to the subpixels 10 in the two adjacent columns. When the display device includes the above-mentioned pixel structure, through setting a connection mode for the gate lines G, it is able to drive the subpixels 10 connected to a same data line S and arranged in a same row through different gate lines G, thereby to ensure a normal display of the pixel structure. In addition, each data line S is configured to apply a data signal to the subpixels 10 in two adjacent columns, so it is able to reduce the quantity of the data lines S without changing a transmission distance of each data line S, thereby to save a layout space of the pixel structure.

It should be appreciated that, the display device may be any product or member having a display function, e.g., television, display, digital photo frame, mobile phone or flat-panel computer. The display device may further include a flexible circuit board, a printed circuit board and a back plate.

A method for driving the above-mentioned pixel structure is further provided in some embodiments of the present disclosure, which includes, within one frame, applying a gate driving signal to the gate lines G one by one, and applying a corresponding data signal to each data line S when the gate driving signal is applied to each gate line G.

To be specific, taking the pixel structure including m*n subpixels 10 as an example, as shown in FIG. 3, when the pixel structure is driven by using the method, within one frame, the gate driving signal may be applied to the gate lines G in an order of G1→G2→G3→G4→G5→→G10→G11→G12. In addition, taking the subpixels 10 connected to a data line S1 as an example, the subpixels 10 may be enabled in an order of (1,1)→(1,2)→(2,1)→(2,2)→(3,1)→(3,2)→(4,1)→(4,2)→(m−1,1)→(m−1,2)→(m,1)→(m,2).

Figure 15:
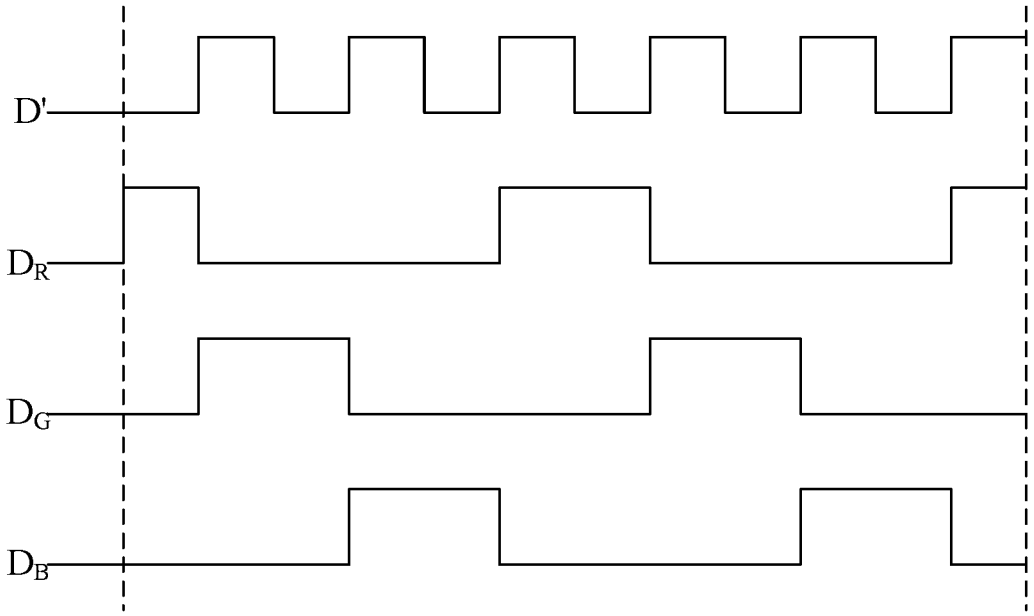
FIG. 15 is a timing sequence diagram of a data signal applied to a data line according to one embodiment of the present disclosure.

As shown in FIG. 15, when the pixel structure of the related art in FIG. 1 is driven to display a monochromatic image, D' represents a change situation of a voltage signal applied to the data line S1 in different timing sequences; when the pixel structure in FIG. 3 is driven to display a red image, DR represents a change situation of a voltage signal applied to the data line S1 in different timing sequences; when the pixel structure in FIG. 3 is driven to display a green image, DG represents a change situation of a voltage signal applied to the data line S1 in different timing sequences; and when the pixel structure in FIG. 3 is driven to display a blue image, DB represents a change situation of a voltage signal applied to the data line S1 in different timing sequences.

More specifically, referring to FIGS. 3 and 15, when the subpixels 10 in two columns are driven by the data line S1 and the red image is to be displayed, a specific driving procedure will be described as follows. A driving signal may be applied to a gate line G1 so as to bring a connection between a red subpixel R in a first row and the data line S1 into a conduction state, and the data line S1 may apply a data signal to the red subpixel R in the first row. The driving signal may be applied to a gate line G2 so as to bring a connection between a green subpixel G in the first row and the data line S1 into a conduction state; at this time, the red image is to be displayed currently, so no data signal may be applied by the data line S1 to the green subpixel G in the first row. The driving signal may be applied to a gate line G3 so as to bring a connection between a green subpixel G in a second row and the data line S1 into a conduction state; identically, no data signal may be applied by the data line S1 to the green subpixel G in the second row. The driving signal may be applied to a gate line G4 so as to bring a connection between a blue subpixel B in the second row and the data line S1 into a conduction state; identically, no data signal may be applied by the data line S1 to the blue subpixel B in the second row. The driving signal may be applied to a gate line G5 so as to bring a connection between a blue subpixel B in a third row and the data line S1 into a conduction state; identically, no data signal may be applied by the data line S1 to the blue subpixel B in the third row. The driving signal may be applied to a gate line G6 so as to bring a connection between a red subpixel R in the third row and the data line S1 into a conduction state, and the data line S1 may apply a data signal to the red subpixel R in the third row. A scanning process of gate lines G7 to G12 may be the same as a scanning process of the gate lines G1 to G6, and thus will not be particularly defined herein.

Based on the above analysis, as compared with the pixel structure of the related art where the data line S1 is charged and discharged for eleven times when the monochromatic image (e.g., the red image) is displayed, the data line S1 may be charged and discharged for five times when the red image is displayed by using the pixel structure in FIG. 3, and the data line S1 may be charged and discharged for four times when the green or blue image is displayed by using the pixel structure in FIG. 3. As a result, when the pixel structure is driven by using the method in the embodiments of the present disclosure to display the monochromatic image, it is able to remarkably reduce the charging and discharging times of the data line S, thereby to significantly reduce a power consumption caused when the pixel structure is driven for display.

Further, when applying the corresponding data signal to each data line S, a data signal applied to the subpixels 10 in each odd-numbered row may have a voltage polarity opposite to a data signal applied to the subpixels 10 in each even-numbered row, and/or a data signal applied to the subpixels 10 in each odd-numbered column may have a voltage polarity opposite to a data signal applied to the subpixels 10 in each even-numbered column.

For example, as shown in FIG. 3, taking the subpixels 10 in the first column and the second column as an example, the applying the data signal to the data line S1 may include: applying a positive voltage signal to a red subpixel R in a first row through the data line S1 when scanning the gate line G1; applying a negative voltage signal to a green subpixel G in the first row through the data line S1 when scanning the gate line G2; applying the negative voltage signal to a green subpixel G in a second row through the data line S1 when scanning the gate line G3; applying the positive voltage signal to a blue subpixel B in the second row through the data line S1 when scanning the gate line G4; applying the positive voltage signal to a blue subpixel B in a third row through the data line S1 when scanning the gate line G5; applying the negative voltage signal to a red subpixel R in the third row through the data line S1 when scanning the gate line G6; . . . , so as to drive the subpixels 10 in the first and second columns.

When the pixel structure in the embodiments of the present disclosure is applied to the liquid crystal display device and the data signals with the corresponding polarities are applied to each data line S by using the above-mentioned method, it is able to prevent liquid crystals from being aged in a direct-current field, thereby to improve a display quality of the liquid crystal display device in a better manner.

In addition, when the pixel structure is driven by using the above-mentioned method to display the monochromatic image, the charging and discharging times of the data line S may be reduced remarkably. As compared with a situation where the pixel structure of the related art in FIG. 1 is driven by using the above method to display the monochromatic image, although a conversion frequency of the signals applied to the data line S increases when the pixel structure in the embodiments of the present disclosure is driven by using the above method (the data signal applied to the subpixels 10 in each odd-numbered row may have a voltage polarity opposite to the data signal applied to the subpixels 10 in each even-numbered row, and/or the data signal applied to the subpixels 10 in each odd-numbered column may have a voltage polarity opposite to the data signal applied to the subpixels 10 in each even-numbered column) to display the monochromatic image, it is still able to reduce the power consumption.

Unless otherwise defined, any technical or scientific term used herein shall have the common meaning understood by a person of ordinary skills. Such words as "first" and "second" used in the specification and claims are merely used to differentiate different components rather than to represent any order, number or importance. Such words as "include" or "including" intends to indicate that an element or object before the word contains an element or object or equivalents thereof listed after the word, without excluding any other element or object. Such words as "connect/connected to" or "couple/coupled to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

It should be appreciated that, in the case that such an element as layer, film, region or substrate is arranged "on" or "under" another element, it may be directly arranged "on" or "under" the other element, or an intermediate element may be arranged therebetween.

In the above description, the features, structures or materials may be combined in any one or more embodiments in an appropriate manner.

The above are merely specific embodiments of the present disclosure, but a protection scope of the present disclosure is not limited thereto. Any modifications or replacements that would easily occur to a person skilled in the art, without departing from the technical scope disclosed in the disclosure, should be encompassed in the protection scope of the present disclosure. Therefore, the protection scope of the present disclosure shall be subject to the protection scope of the claims.

What is claimed is:

1. A method for driving a pixel structure, wherein the pixel structure comprises a plurality of gate lines, a plurality of data lines each crossing the plurality of gate lines, and a plurality of subpixels arranged in an array form, wherein subpixels in each row correspond to two gate lines, one of the two gate lines is connected to parts of the subpixels in the row, and the other of the two gate lines is connected to the other subpixels in the row;

each data line corresponds to the subpixels in two adjacent columns, the subpixels in one column of the two adjacent columns are arranged at a first side of the data line, the subpixels in the other column of the two adjacent columns are arranged at a second side of the data line opposite to the first side, and the data line is connected to the subpixels in the two adjacent columns;

among the subpixels in each row, three adjacent subpixels are in different colors and form a complete pixel unit;

among the subpixels in each column, three adjacent subpixels are in different colors and form the complete pixel unit; and among the subpixels in the two adjacent columns, the subpixels in two adjacent rows form two complete pixel units each comprising three subpixels, and two of the three subpixels are shared by the two complete pixel units;

wherein among the subpixels in the two adjacent columns, a subpixel of the subpixels in a first row of any two adjacent rows at the first side is in a same color as a subpixel of the subpixels in a second row of the any two adjacent rows at the second side, and a subpixel of the subpixels in the first row of the any two adjacent rows at the second side is in a color different from a subpixel of the subpixels in the second row of the any two adjacent rows at the first side; or, among the subpixels in the two adjacent columns, a subpixel of the subpixels in a second row of any two adjacent rows at the first side is in a same color as a subpixel of the subpixels in a first row of the any two adjacent rows at the second side, and a subpixel of the subpixels in the second row of the any two adjacent rows at the second side is in a color different from a subpixel of the subpixels in the first row of the any two adjacent rows at the first side;

wherein the method comprises, within one frame, applying a gate driving signal to the gate lines one by one, and applying a corresponding data signal to each data line when the gate driving signal is applied to each gate line;

wherein when applying the corresponding data signal to each data line, a data signal applied to the subpixels in each odd-numbered row corresponding to the same data line has a voltage polarity opposite to a data signal applied to the subpixels in each even-numbered row corresponding to the same data line, and a data signal applied to the subpixels in each odd-numbered column corresponding to the same data line has a voltage polarity opposite to a data signal applied to the subpixels in each even-numbered column corresponding to the same data line.

2. The method according to claim 1, wherein the subpixels in each row are arranged between two corresponding gate lines, one of the two gate lines corresponding to the subpixels in each row is connected to odd-numbered subpixels of the subpixels in the row, and the other of the two gate lines is connected to even-numbered subpixels of the subpixels in the row.

3. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a red subpixel, a green subpixel and a blue subpixel arranged sequentially in a direction perpendicular to the extension direction of the data line from the second side to the first side of the data line, the second pixel unit comprises a green subpixel, a blue subpixel and a red subpixel arranged sequentially in the direction perpendicular to the extension direction of the data line from the second side to the first side of the data line, and the third pixel unit comprises a blue subpixel, a red subpixel and a green subpixel arranged sequentially in the direction perpendicular to the extension direction of the data line from the second side to the first side of the data line.

4. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a red subpixel, a blue subpixel and a green subpixel arranged sequentially in a direction perpendicular to the extension direction of the data line from the second side to the first side of the data line, the second pixel unit comprises a blue subpixel, a green subpixel and a red subpixel arranged sequentially in the direction perpendicular to the extension direction of the data line from the second side to the first side of the data line, and the third pixel unit comprises a green subpixel, a red subpixel and a blue subpixel arranged sequentially in the direction perpendicular to the extension direction of the data line from the second side to the first side of the data line.

5. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a green subpixel, a blue subpixel and a red subpixel arranged sequentially in a direction perpendicular to the extension direction of the data line from the second side to the first side of the data line, the second pixel unit comprises a blue subpixel, a red subpixel and a green subpixel arranged sequentially in the direction perpendicular to the extension direction of the data line from the second side to the first side of the data line, and the third pixel unit comprises a red subpixel, a green subpixel and a blue subpixel arranged sequentially in the direction perpendicular to the extension direction of the data line from the second side to the first side of the data line.

6. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a green subpixel, a red subpixel and a blue subpixel arranged sequentially in a direction perpendicular to the extension direction of the data line from the second side to the first side of the data line, the second pixel unit comprises a red subpixel, a blue subpixel and a green subpixel arranged sequentially in the direction perpendicular to the extension direction of the data line from the second side to the first side of the data line, and the third pixel unit comprises a blue subpixel, a green subpixel and a red subpixel arranged sequentially in the direction perpendicular to the extension direction of the data line from the second side to the first side of the data line.

7. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a blue subpixel, a red subpixel and a green subpixel arranged sequentially in a direction perpendicular to the extension direction of the data line from the second side to the first side of the data line, the second pixel unit comprises a red subpixel, a green subpixel and a blue subpixel arranged sequentially in the direction perpendicular to the extension direction of the data line from the second side to the first side of the data line, and the third pixel unit comprises a green subpixel, a blue subpixel and a red subpixel arranged sequentially in the direction perpendicular to the extension direction of the data line from the second side to the first side of the data line.

8. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a blue subpixel, a green subpixel and a red subpixel arranged sequentially in a direction perpendicular to the extension direction of the data line from the second side to the first side of the data line, the second pixel unit comprises a green subpixel, a red subpixel and a blue subpixel arranged sequentially in the direction perpendicular to the extension direction of the data line from the second side to the first side of the data line, and the third pixel unit comprises a red subpixel, a blue subpixel and a green subpixel arranged sequentially in the direction perpendicular to the extension direction of the data line from the second side to the first side of the data line.

9. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a red subpixel, a green subpixel and a blue subpixel arranged sequentially in a direction perpendicular to the extension direction of the data line from the first side to the second side of the data line, the second pixel unit comprises a green subpixel, a blue subpixel and a red subpixel arranged sequentially in the direction perpendicular to the extension direction of the data line from the first side to the second side of the data line, and the third pixel unit comprises a blue subpixel, a red subpixel and a green subpixel arranged sequentially in the direction perpendicular to the extension direction of the data line from the first side to the second side of the data line.

10. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a red subpixel, a blue subpixel and a green subpixel arranged sequentially in a direction perpendicular to the extension direction of the data line from the first side to the second side of the data line, the second pixel unit comprises a blue subpixel, a green subpixel and a red subpixel arranged sequentially in the direction perpendicular to the extension direction of the data line from the first side to the second side of the data line, and the third pixel unit comprises a green subpixel, a red subpixel and a blue subpixel arranged sequentially in the direction perpendicular to the extension direction of the data line from the first side to the second side of the data line.

11. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a green subpixel, a blue subpixel and a red subpixel arranged sequentially in a direction perpendicular to the extension direction of the data line from the first side to the second side of the data line, the second pixel unit comprises a blue subpixel, a red subpixel and a green subpixel arranged sequentially in the direction perpendicular to the extension direction of the data line from the first side to the second side of the data line, and the third pixel unit comprises a red subpixel, a green subpixel and a blue subpixel arranged sequentially in the direction perpendicular to the extension direction of the data line from the first side to the second side of the data line.

12. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a green subpixel, a red subpixel and a blue subpixel arranged sequentially in a direction perpendicular to the extension direction of the data line from the first side to the second side of the data line, the second pixel unit comprises a red subpixel, a blue subpixel and a green subpixel arranged sequentially in the direction perpendicular to the extension direction of the data line from the first side to the second side of the data line, and the third pixel unit comprises a blue subpixel, a green subpixel and a red subpixel arranged sequentially in the direction perpendicular to the extension direction of the data line from the first side to the second side of the data line.

13. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a blue subpixel, a red subpixel and a green subpixel arranged sequentially in a direction perpendicular to the extension direction of the data line from the first side to the second side of the data line, the second pixel unit comprises a red subpixel, a green subpixel and a blue subpixel arranged sequentially in the direction perpendicular to the extension direction of the data line from the first side to the second side of the data line, and the third pixel unit comprises a green subpixel, a blue subpixel and a red subpixel arranged sequentially in the direction perpendicular to the extension direction of the data line from the first side to the second side of the data line.

14. The method according to claim 1, wherein the plurality of subpixels comprises a plurality of red subpixels, a plurality of green subpixels and a plurality of blue subpixels, the plurality of subpixels forms a plurality of repetition modules arranged in an array form, and each repetition module comprises a first pixel unit, a second pixel unit and a third pixel unit arranged sequentially in an extension direction of the data line, and wherein the first pixel unit comprises a blue subpixel, a green subpixel and a red subpixel arranged sequentially in a direction perpendicular to the extension direction of the data line from the first side to the second side of the data line, the second pixel unit comprises a green subpixel, a red subpixel and a blue subpixel arranged sequentially in the direction perpendicular to the extension direction of the data line from the first side to the second side of the data line, and the third pixel unit comprises a red subpixel, a blue subpixel and a green subpixel arranged sequentially in the direction perpendicular to the extension direction of the data line from the first side to the second side of the data line.

* * * * *